US008210511B2

(12) United States Patent
Stauber

(10) Patent No.: US 8,210,511 B2
(45) Date of Patent: Jul. 3, 2012

(54) METHOD AND DEVICE FOR CREATING A UNIFIED PRINTED PRODUCT FLOW FROM TWO FED PRINTED PRODUCT FLOWS

(75) Inventor: H. Ulrich Stauber, Grut (CH)

(73) Assignee: Ferag AG, Hinwil (CH)

( * ) Notice: Subject to any disclaimer, the term of this patent is extended or adjusted under 35 U.S.C. 154(b) by 35 days.

(21) Appl. No.: 12/868,124

(22) Filed: Aug. 25, 2010

(65) Prior Publication Data

US 2011/0031092 A1 Feb. 10, 2011

Related U.S. Application Data

(62) Division of application No. 12/158,153, filed as application No. PCT/CH2006/000696 on Dec. 13, 2006, now Pat. No. 7,789,380.

(30) Foreign Application Priority Data

Dec. 21, 2005 (CH) ..... 2029/05

(51) Int. Cl.

| | |
|---|---|
| ***B65H 3/44*** | (2006.01) |
| ***B65H 5/30*** | (2006.01) |
| ***B65H 39/00*** | (2006.01) |
| ***B65H 43/00*** | (2006.01) |
| ***B65H 5/00*** | (2006.01) |
| ***B42B 2/00*** | (2006.01) |

(52) U.S. Cl. ..... 270/52.01; 270/52.07; 270/52.08; 270/52.09; 270/59; 271/9.13; 271/225

(58) Field of Classification Search ..... None
See application file for complete search history.

(56) References Cited

U.S. PATENT DOCUMENTS

| | | | | |
|---|---|---|---|---|
| 3,178,170 | A * | 4/1965 | Walck et al. | 270/52.01 |
| 4,674,375 | A * | 6/1987 | Golicz | 83/91 |
| 6,341,773 | B1 * | 1/2002 | Aprato et al. | 271/9.13 |

FOREIGN PATENT DOCUMENTS

| | | |
|---|---|---|
| EP | 0 155 633 A2 | 9/1985 |
| EP | 1 277 684 A1 | 1/2003 |
| FR | 2 499 959 | 8/1982 |
| GB | 2 025 907 | 1/1980 |

* cited by examiner

*Primary Examiner* — Gene Crawford
*Assistant Examiner* — Yolanda Jones
(74) *Attorney, Agent, or Firm* — Rankin, Hill & Clark LLP

(57) ABSTRACT

Two supply streams of printed products are combined to form a combined printed-product stream. For this purpose, the supply streams are conveyed into a combining region (V) in a main conveying direction (F) in a state in which they, for example, rest loosely on conveying surfaces, are parallel to one another, adjacent to one another and on the same level, inner and outer edges of the printed products (P) of the two supply streams being oriented parallel to the main conveying direction (F). At the entrance to the combining region (V), the inner edge region of each printed product of the first supply stream is raised and, as they are conveyed through the combining region (V), the printed products of the two supply streams are pushed transversely to the main conveying direction (F) and towards one another. An inner edge region of a printed product of the second supply stream is, thus, respectively pushed beneath the raised inner edge region of the printed product of the first supply stream, in which case these supply streams end up located one upon the other, and are conveyed away in this state.

8 Claims, 4 Drawing Sheets

METHOD AND DEVICE FOR CREATING A UNIFIED PRINTED PRODUCT FLOW FROM TWO FED PRINTED PRODUCT FLOWS

This application is a divisional of U.S. patent application Ser. No. 12/158,153, filed on Jun. 19, 2008 and currently pending, and incorporates the entire disclosure therein by reference.

BACKGROUND OF THE INVENTION

The invention lies in the field of conveyor technology and relates to a method and to a device according to the preambles of the respective, independent claims. The method and the device serve for creating a unified printed product flow from two fed printed product flows (feed flows).

It is known to unify two fed printed product flows, which arise, for example, on separating two-ups, into a single printed product flow, by way of conveying the fed printed product flows parallel to one another and next to one another, but at two different levels, and by way of pushing the printed products of the higher conveyed flow for unification laterally onto the printed products of the lower conveyed flow for the unification. Devices, with which supplied printed product flows are unified into a single printed product flow in the mentioned way and manner, are for example, described in the publications GB-2025907 and EP-1277684. According to GB-2025907, the unified printed product flow continues the lower conveyed feed flow in a straight-lined manner, and further unifications follow the first unification, wherein for this, the printed products of the further feed flows are laterally displaced over a further path. According to EP-1277684, the unified printed product flow has a direction which is rotated by 90° with respect to the feed flows, and the printed products of the feed flows are deposited onto one another in an alternating manner and overlapping one another, in a manner such that the unified printed product flow is an imbricate flow. The advantage of the printed product flow unification by way of a parallel feed at different levels, and by way of lateral displacement of the printed products fed at a higher level, is the simplicity of the devices which are required for this. The disadvantage of this lies in the fact that the printed products fall from the higher to the lower level in an essentially unguided manner, and by way of this, one may not achieve a very accurate alignment of the printed products which are applied on one another, in the unified printed product flow. For this reason, an additional alignment of the printed products after the unification must be provided where there are high demands with regard to this accuracy.

A device for the unification of two fed printed product flows is described in the publication EP-01277684, with which greater accuracies with regard to the alignment of the printed products in the unified printed product flow may be achieved. According to this publication, the one of the feed flows is led in a conveyor path loop over the other feed flow, and each printed product conveyed through the loop is deposited onto a printed product transported therebelow on the non-looped conveyor path. The device necessary for the looping method is evidently significantly more complicated and, thus, more expensive compared to devices for the unification methods by way of lateral displacement, as are described further above.

A method is described in the publication EP-155633, with which two fed imbricate flows are unified into a single imbricate flow, wherein in the unified imbricate flow, each imbrication consists of two printed products applied onto one another, in each case one from each fed printed product flow.

The fed imbricate flows taper to one another at an acute angle, so that the products of the two flows meet one another in each case at a corner. Thereby, the leading corner of the products of the one flow, and the edge following this corner are pressed downwards, so that the corner of the respective product of the other flow is introduced between the products of the one flow. By way of the leading-together at an acute angle, the products of the two imbricate flows are pushed into one another and finally are aligned to one another by way of lateral guides.

BRIEF SUMMARY OF THE INVENTION

It is then the object of the invention, to provide a method and a device for unifying two fed printed product flows, which on the one hand are very simple, in particular with regard to the device, which however on the other hand render it possible to achieve a high accuracy of the mutual alignment of the printed products in the unified indeed product flow, without an additional alignment.

This object is achieved by a method and a device as are defined in the patent claims.

According to the method according to the invention, the fed printed product flows are fed parallel, next to one another in a main conveyor direction and at the same level into a unification region, wherein the printed products are aligned in a manner such that of the printed products of both flows, in each case two edges run parallel to one another and parallel to the main conveyor direction, and in each case inner ones (directed towards one another) of the two edges are distanced only little from one another, and wherein the printed products are conveyed, for example, in a loose manner on a conveyor surface in a lying manner. The printed products are conveyed essential continuously into the unification region, and through the unification region The inner edge region of each printed product of the first feed flow is lifted above the level of the conveyor surface at the entry of the unification region, whereas, as the case may be, the outer edge region is pressed onto the conveyor surface for preventing a displacement of the printed product. The printed product then, with a lifted, inner edge region, is conveyed further and simultaneously is pushed transversely to the main conveyor direction towards the second feed flow. Essentially simultaneously to this, a printed product of the second feed flow is likewise pushed transversely to the main conveyor direction towards the first feed flow, wherein the inner edge region of this printed product is however not lifted, so that it is pushed by the transverse displacement below the lifted inner edge region of the printed product of the first feed flow. As soon as the transverse pushing is advanced in such a manner that the two inner edge regions are arranged over one another, the lifted inner edge region of the printed product of the first feed flow is lowered onto the inner edge region of the printed product of the second feed flow, wherein the two printed products are conveyed further in the main conveyor direction, and are pushed further towards one another transversely to the main conveyor direction, until they lie completely on one another for example The printed products of both feed flows in the regions of their outer edges aligned parallel to the main conveyor direction are gripped for the displacement transverse to the main conveyor direction, so that the alignment of these edge regions is retained and the position of the printed products during the conveying through the unification region, and the simultaneous transverse displacement is exactly defined at all times. The transverse displacement and advantageously also the lateral gripping and guiding stops as soon as the printed products of the two feed flows lie on one another in the desired manner, and the unified printed products of the two feed flows are in turn conveyed further, lying in a loose manner on a conveyor surface, as a unified printed product flow.

It is also possible to convey the printed products held, for example, by way of grippers, at the outer edge regions, already in the feed flows, and then to displace them transversely by way of these grippers. In such cases, the conveyor surfaces for the feed flows have a supporting function, or may be completely absent as the case may be. It is also possible to transversely displace the printed products with pushers, thus without gripping them, wherein the pushers advantageously also run in the main conveyor direction with the printed products.

The device according to the invention, thus, comprises conveyor surfaces or other suitable conveyor means for conveying the feed flows in and through the unification region, and for conveying the unified printed product flow away out of the unification region, as well as a lifting means acting on inner edge regions of the printed products of the first feed flow and in each case a transverse pushing means acting on the printed products of the first and second feed flow.

Advantageously, arrangements of revolvingly driven belts or chains serve as conveyor surfaces, whose conveyor paths run parallel to the main conveyor direction and on a common level and which may be driven with the same speed and which in each case form a conveyor surface for the two feed flows, said conveyor surfaces transverse to the main conveyor direction being, for example, narrower than the width of the printed products to be handled, transverse to the main conveyor direction, in a manner such that outer edge regions of the fed printed products project beyond the conveyor surfaces and may be gripped by the transverse displacement by way of this.

The lifting means is arranged at the entry of the unification region. It acts on the inner edge region of the printed products of the first feed flow by way of it lifting these by more than the thickness of the printed products of the second feed flow. The lifting means is advantageously designed in a manner such that its effect stops when the inner edge region of a printed product of the second feed flow is positioned below the lifted edge region. The lifting means may act from below or from above onto the printed products, and lift the inner edge regions in a mechanical or pneumatic manner. A lifting means which is simple to realize is, for example, a wedge-like element rising laterally off the conveyor surface for the first feed flow above the level of the conveyor surface, or a revolving belt, whose conveyor path rises above the level of the conveyor surfaces and is driven in the main conveyor direction at the same speed as the conveyor surfaces. It is also possible to arrange the conveyor path of the innermost conveyor belt higher in the respective region, so that this innermost conveyor belt may assume the function of the lifting means.

If the lifting means is to act separately from the conveyor means in the mentioned manner, from below onto the inner edge regions of the printed products of the first feed flow, the conveyor surface at least for the first feed flow is to be designed in a manner such that not only the outer, but also the inner edge regions of the printed products project thereabove.

The two transverse pushing means are arranged symmetrically to one another in each case on the outer side of the conveyor path of each feed flow and they are advantageously designed for gripping the outer edge regions of the printed products, but may also act on these in a purely pushing manner. The transverse pushing means are arranged in a manner such that their transversely pushing effect begins in the region of the lifting means. The transverse pushing means are designed in order to convey the printed products in cooperation with the conveyor surface in the main conveyor direction through the unification region and to simultaneously push them towards one another, or over one another, transversely to the main conveyor direction. Each transverse pushing means, for example, comprises an upper and a lower pressing belt running in opposite directions, wherein the two pressing belts may be pressed against one another with suitable means, and wherein the pressing gap between the pressing belts is arranged essentially at the level of the conveyor surfaces. The transverse pushing means could also be formed as revolving transporters with grippers, wherein the transporters are arranged, for example, parallel to the main transport direction, and the grippers are displaceable transversely to the main conveyor direction. A transverse pushing means designed in such a manner may also be designed extended upstream and may not only convey the printed product through the unification region, but also the feed flows towards the unification region.

In the preferred embodiment of the method according to the invention, the printed products conveyed in the two feed flows have the same format and are conveyed one after the other (not overlapping one another). It is, for example, the case of printed products which are manufactured by way of separating two-ups. In each case, a printed product of the first feed flow and a printed product of the second feed flow are aligned onto one another in the main conveyor direction, so that they are also aligned to one another in the main conveyor direction in the unified printed product flow, which means they lie precisely on one another. Moreover, the printed products of the two feed flows are pushed towards one another transversely to the main conveyor direction to such an extent, that they are also aligned to one another transversely to the main conveyor direction in the unified printed product flow. Also, more than two feed flows may be unified into a single printed product feed flow in several unification regions which follow one another in the main conveyor direction, according to the method according to the invention. In this manner for example, printed products which are manufactured by way of separating multiple-ups, may be stacked on one another in the simplest way and manner, wherein for example, the products originating from a single multiple-up are grouped together in each stack.

The features of the preferred embodiment of the method according to the invention which are mentioned above (exact alignment of the printed products lying on one another in the unified printed product flow, in the main conveyor direction and transversely thereto), are no precondition for the method according to the invention. The printed products of the two fed printed product flows may be slightly staggered in the main conveyor direction, may be only partly applied on one another by way of the transverse displacement and/or may have formats which are different form one another. The printed products in the feed flows may also be conveyed overlapping one another in the feed flows.

BRIEF DESCRIPTION OF THE DRAWINGS

The method and the exemplary embodiments of the device according to the invention are described in detail by way of the following figures. Thereby, there are shown in.

DETAILED DESCRIPTION OF THE INVENTION

Figure 1:
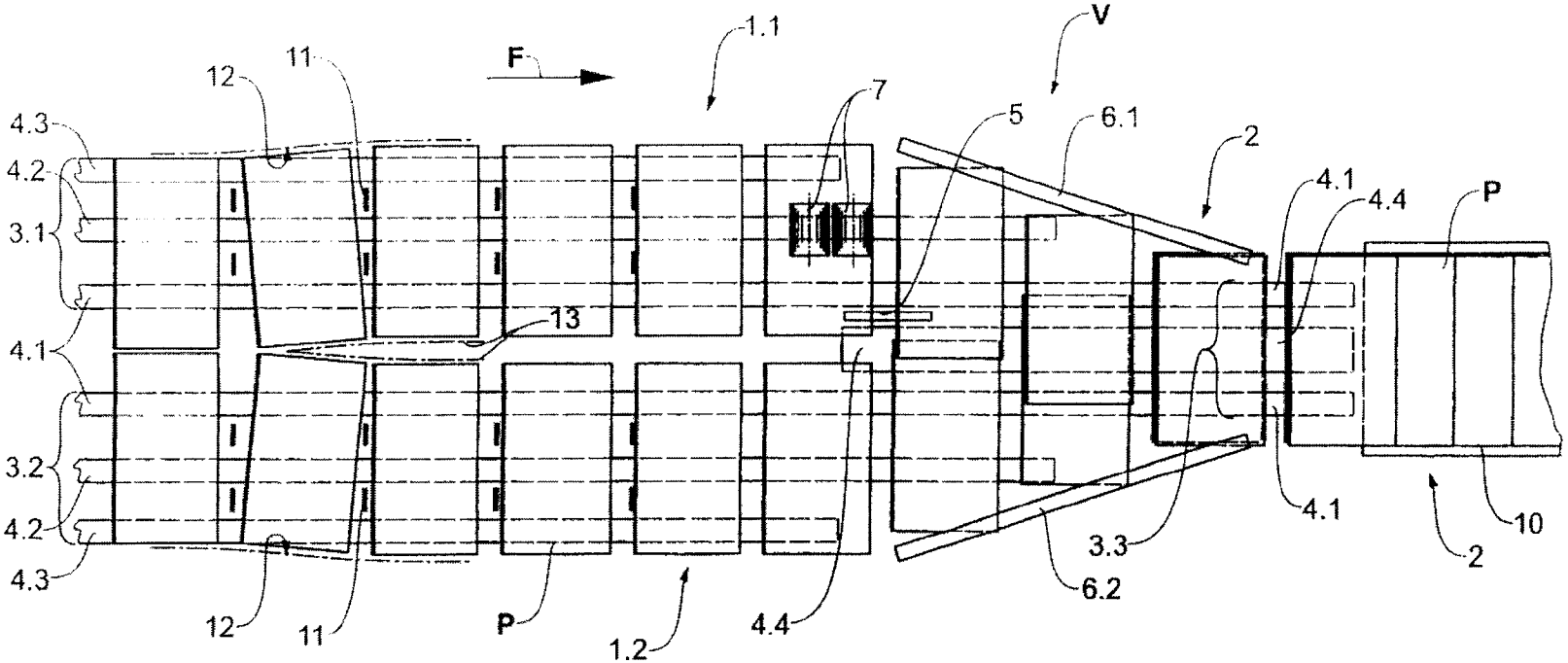
FIG. 1 a schematic plan view of an exemplary embodiment of the method according to the invention, for carrying out the preferred embodiment of the method according to the invention, FIGS. 2 and 3 schematic lateral views of the device according to FIG. 1, wherein in particular, the printed products are represented in FIG. 2, and in particular the device parts are represented in FIG. 3, FIGS. 4 to 7 schematic diagrams of further exemplary embodiments of the method according to the invention.

FIG. 1 is a schematic plan view of an exemplary embodiment of the device according to the invention, with which the preferred embodiment of the method according to the invention may be carried out. This method lies in feeding equal-format printed products P one after the other in pairs of printed products which are aligned to one another parallel to a main conveyor direction F, in the two feed flows 1.1 and 1.2, and unifying the two feed flows 1.1 and 1.2 in a manner such that the two printed products of each pair lie exactly on one another in the unified printed product flow 2.

The feed flows 1.1 and 1.2 are conveyed lying in a loose manner on, in each case, one conveyor surface 3.1 and 3.2, wherein the conveyor surfaces are advantageously formed from a plurality, for example from in each case three conveyor belts 4.1, 4.2 and 4.3 or conveyor chains, which revolve parallel to one another. The conveyor paths of the conveyor belts all run parallel to the main conveyor direction F on a common level, and the conveyor surfaces 3.1 and 3.2 which are formed by way of this, transversely to the main conveyor direction F are, for example, narrower than the width of the printed products P, which for the feeding, project on the inside (on the side directed towards the other feed flow) as well as on the outside (on the side directed away from the other feed flow) beyond the conveyor surfaces 3.1 and 3.2.

A mechanical lifting means 5 which acts from below, is arranged at the entry of the unification region V, and specifically on the inner side of the conveyor surface 3.1 for the first feed flow 1.1. This feed flow is conveyed on the conveyor surface 3.1 in a manner such that the inner edge regions of the printed products project beyond the inner edge of the conveyor surface, into the region of the lifting means 5.

Since such a mechanical lifting means 5 acting from below represents an obstacle for the transverse displacement of the printed products of the second feed flow 1.2, it is to be arranged, and its extension parallel to the main conveyor direction F to be limited, or matched to the arrangement of the transverse pushing means, in a manner such that a printed product of the first feed flow is securely lifted when the inner edge region of the printed product of the second feed flow is pushed therebelow, but that it does not get in the way of a further pushing thereunder.

If the lifting means acts from above, is therefore a suction wheel for example, the printed products of the first feed flow 1.1 do not need to project beyond the conveyor surface, and the active region of the lifting means must not be limited in the manner described above, since such a lifting means does not come into conflict with the printed products of the second feed flow 1.2 on transverse displacement.

In order for a printed product of the first feed flow not to be displaced by way of the lifting of its inner edge region on the conveyor surface 3.1, it may be advantageous to press the respective printed product in the region of its outer edge against the conveyor surface, for which for example, pressing rollers are provided, which are pressed with suitable means against the conveyor surface 3.1.

The transverse pushing means 6.1 and 6.1 extend symmetrically to one another on the respective outer side of the two conveyor surfaces 3.1 and 3.2 over the complete length of the unification region V. They run in the main conveyor direction towards one another, and the conveyor surfaces 3.1 and 3.2 towards the exit of the unification region V become narrower and unify into the conveyor surface 3.3 for the unified printed product flow 2. This, for example, is realised in that the outer conveyor belts 4.3 and 4.2 in the unification region V, for the outside stop in a staggered manner from the outside to the inside, and only the two innermost conveyor belts 4.1 extend through the unification region V and further, as is represented in FIG. 1.

It may be advantageous, in particular for the handling of less stiff printed products P, to arrange a further, central conveyor belt 4.4 between the inner conveyor belts 4.1 in the unification region V, said further central conveyor belt supporting the inner edge region of the printed products P of the second feed flow 1.2 during the transverse displacement, in a manner such that it may be pushed without any problem onto the inner conveyor belt 4.1 of the conveyor surface 3.1 for the first conveyor flow 1.1. It is also possible to arrange the conveyor surface 3.2 of the second feed flow 1.2 in a manner such that the inner edge regions of the printed products fed in this flow do not project beyond the conveyor surface, so that these inner edge regions, on transverse displacement, only need to be pushed over a very small distance (approx. width of the lifting means) between the conveyor surface 3.2 for the second feed flow 1.2 and the conveyor surface 3.1 for the first feed flow 1.1. The conveyor surfaces are to be designed in a manner such that the printed products may be pushed thereabove with little resistance and despite this, in a securely guided manner.

The unified printed product flow 2, in which pairs of in each case two printed products lying exactly on one another, are conveyed one after the other, is conveyed on the two inner conveyor belts 4.1 out of the unification region V, and may, for example, be transferred by way of transfer to a somewhat deeper lying and suitably slower running conveyor belt 10, in a manner such that the pairs overlap on the further conveyor belt 10, which means they form an imbricate flow.

As already mentioned further above, the printed products arising from the separation of two-ups may be conveyed in the two feed flows 1.1 and 1.2, wherein the two conveyor surfaces 3.1 and 3.2 advantageously connect directly to the separating device. Thereby, it is advantageous to align the printed products to the conveyor surfaces 3.1 and 3.2 before they are led into the unification region V. The alignment in the main conveyor direction F is effected for example in the manner known per se by way of alignment cams 11, which project beyond the conveyor surfaces 3.1 and 3.2 and are conveyed more quickly than the printed products, in a manner such that these catch these up and push them slightly in an alignment region. The alignment transverse to the main conveyor direction is effected, for example, in a known way and manner by way of lateral alignment plates (represented by dot dashed lines 12) against which the printed products are pushed from the middle by way of counter plates (dot-dashed lines 13). Thereby, simultaneously, the lateral distance between printed products aligned to one another in the main conveyor direction is increased somewhat, by which means an effect of the lifting means 5 on the printed products of the second feed flow 1.2 is securely prevented.

Figure 2:
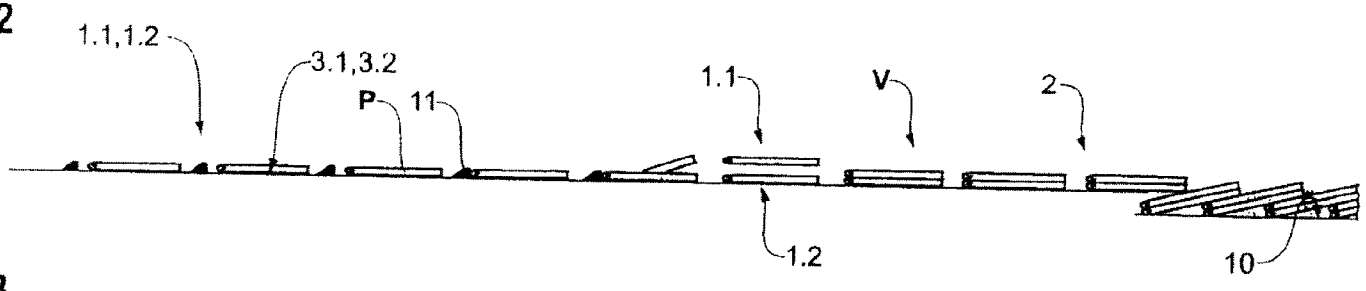
Figure 3:
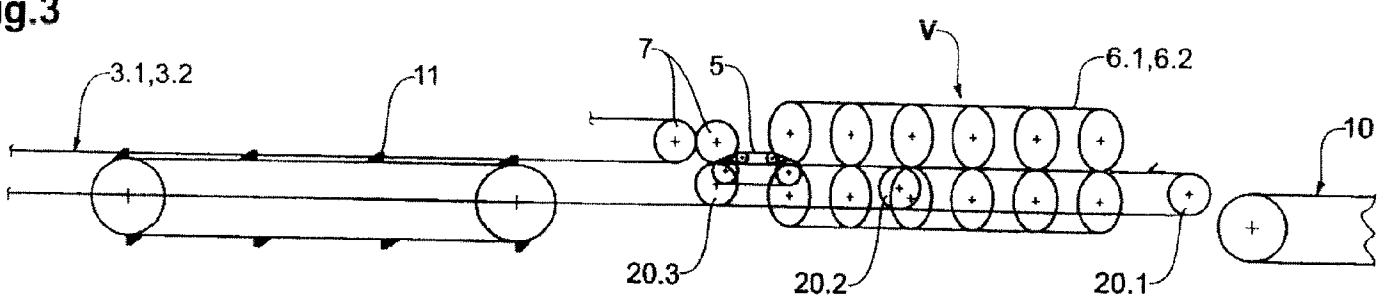

FIGS. 2 and 3 are lateral views of the device according to FIG. 1, wherein in FIG. 2 it is particularly the printed products P which are represented, and in FIG. 3 it is the device parts. The same elements are indicated with the same reference numerals as in FIG. 1. The same elements are indicated with the same reference numerals as in FIG. 1 FIG. 2 in particular illustrates the lifting of the inner edge regions of the printed products of the first feed flow 1.1 by more than the thickness of the printed products of the second feed flow 1.2 at the entry of the unification region V, the deposition of these edge regions onto the printed products of the second feed flow 1.2, and the creation of an imbricate flow from the unified printed product flow 2 running out from the unification region V FIG. 3 illustrates in particular the lifting means 5 which is designed as a revolving belt, the transverse pushing means 6.1 and 6.2, the pressing rollers 7 and the staggered ends of the conveyor belts (respective deflection rollers 20.1, 20.2, and 20.3 for conveyor belts 4.1, 4.2 and 4.3). The transverse pushing means 6.1 and 6.2 in each case comprise two revolving pressing belts which may be pressed against one another, wherein the pressing gap formed between the pressing belts is arranged at the level of the conveyor surfaces 3.1 and 3.2.

FIGS. 4 to 7 are schematic diagrams (plan view as FIG. 1) of further, exemplary embodiments of the method according to the invention, wherein in each case only the printed products, and in an indicated manner, the conveyor belts are represented.

Figure 4:
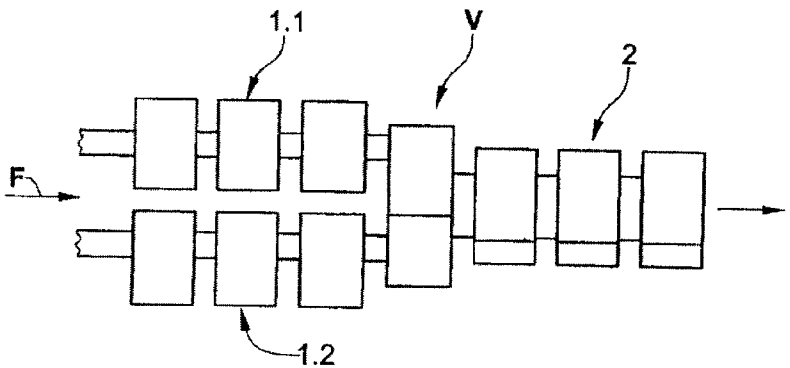

According to FIG. 4, the printed products fed in the feed flows 1.1 and 1.2 have the same formats, are conveyed one after the other and are aligned to one another in the main conveyor direction F. In the unification region V, the printed products are only displaced transversely, so far that they do not completely lie on one another in the unified printed product flow 2.

Figure 5:
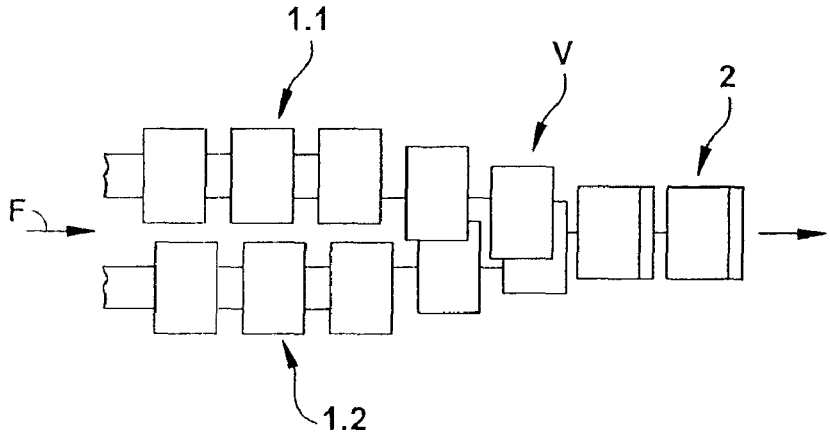

According to FIG. 5, the printed products fed in the two feed flows 1.1 and 1.2 have the same formats, are conveyed one after the other, but are slightly staggered in the main conveyor direction F. They are completely pushed onto one another in the unification region V, so that in the unified printed product flow, they are staggered in the main conveyor direction F and are aligned to one another transversely thereto. The staggering in the main conveyor direction F may not be greater than the distance between the printed products conveyed in the feed flows 1.1 and 1.2.

Figure 6:
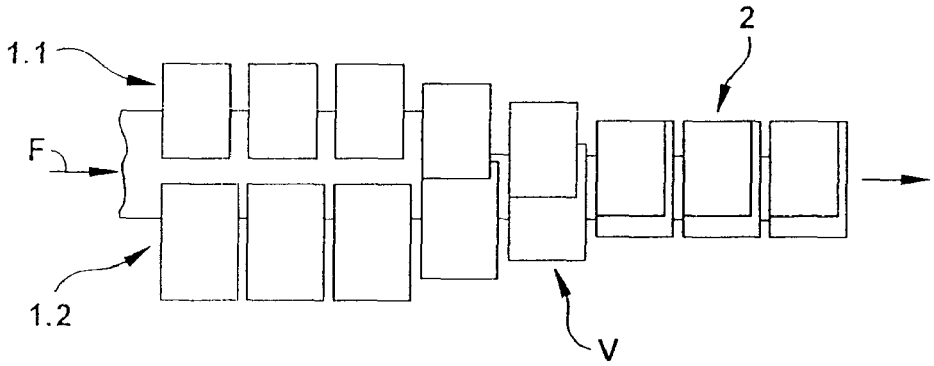

According to FIG. 6, the printed products fed in the two feed flows 1.1 and 1.2 have different formats, are conveyed one after the other, and their trailing edges are aligned to one another in the main conveyor direction F. In the unified printed products flow 2, in each case a corner of the trailing edge are aligned to one another in the pairs of printed products which are conveyed one after the other.

Figure 7:
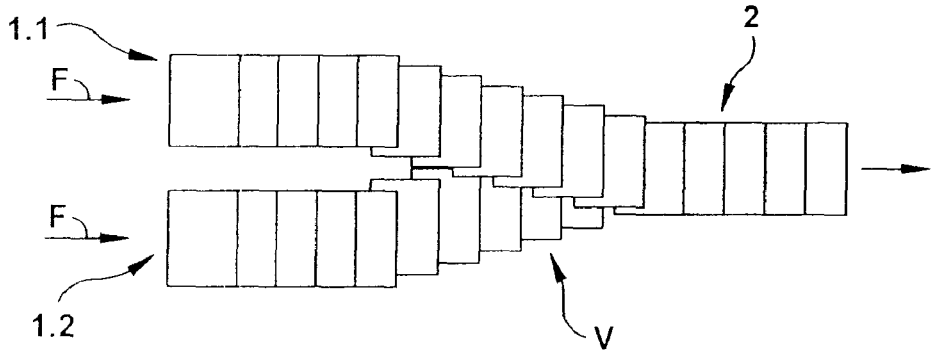

According to FIG. 7, the printed products fed in the two feed flows 1.1 and 1.2 have the same formats, are conveyed overlapping one another and are aligned to one another in the main conveyor direction F. By way of the transverse displacement, they are pushed completely over one another, so that in the unified printed product flow, they lie on one another in a directed manner. The unified printed product flow 2 according to FIG. 7 consists of two imbricate flows lying on one another, wherein the printed products of a printed product pair which are aligned to one another reach between and below the printed products of the following pair. The printed product pairs from such a unified printed product flow 2 may be singularized by way of gripping in each case the frontmost pair at the leading edge, and accelerating it with respect to the unified printed product flow 2.

Figure 8:
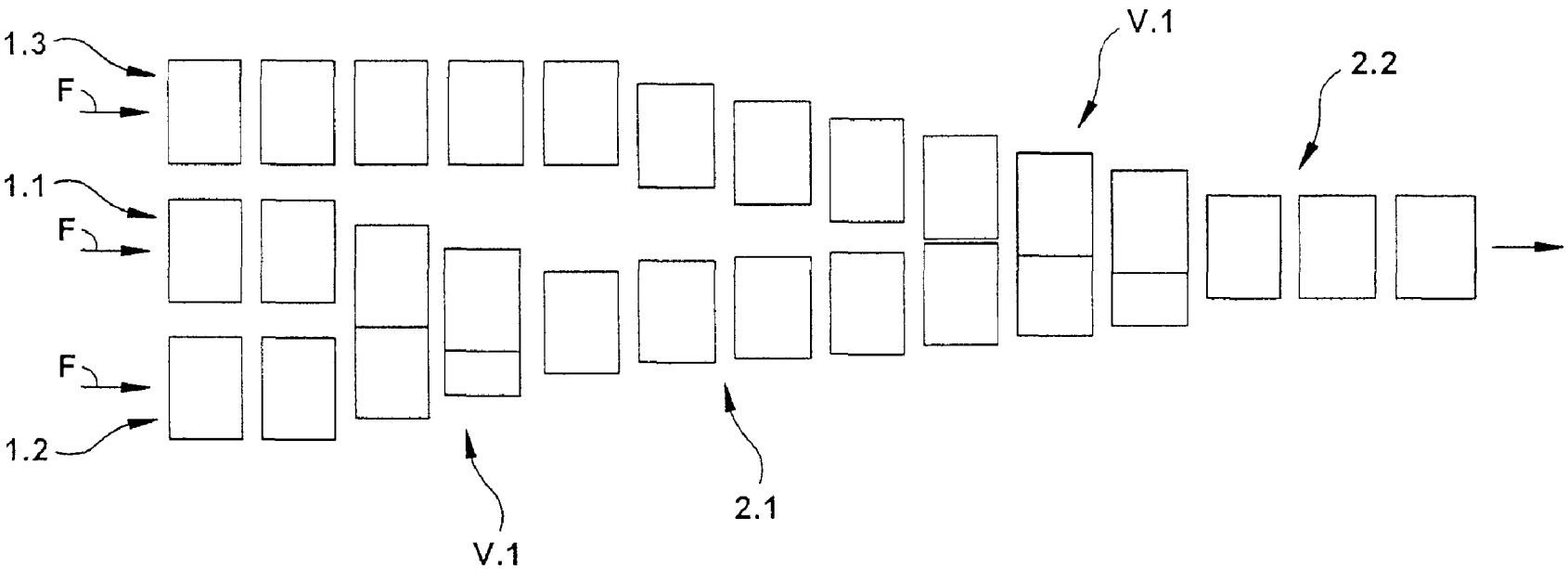
FIG. 8 the schematic diagram of one embodiment of the method according to the invention, with two unification regions, or for unifying three feed flows into a unified printed product flow.

FIG. 8 shows a unification according to the method according to the invention, in which in two successive unification regions V.1 and V.2, three feed flows 1.1, 1.2 and 1.3 are unified into a unified printed product flow 2.2. The printed products conveyed in the feed flows 1.1, 1.2 and 1.3 originate, for example, from suitably separated three-ups. In the first unification region V.1, the feed flows 1.1 and 1.2 are unified into the first unified printed product flow 2.1 as is represented, for example, in the FIGS. 1 to 3. In the second unification region V.2, the feed flow 1.3 is unified with the first unified printed product flow 2.1 into the second unified printed product flow 2.2, again as is represented in the FIGS. 1 to 3 for example.

I claim:

1. A device for the unification of a first and a second feed flow of printed products, said device for conveying the feed flows comprising:

two conveyors for conveying the feed flows parallel to one another and next to one another in a main conveyor direction towards a unification region wherein at least one of said conveyors extends through the unification region, and said device further comprising a transverse pushing means arranged in the unification region, wherein the two conveyors have a same level, wherein the device further comprises a lifting means arranged at the entry of the unification region, wherein the lifting means lifts the inner edge regions of the printed products conveyed in the first feed flow, wherein the transverse pushing means comprises two transverse pushing means, said transverse pushing means are arranged symmetrically to one another in the unification region and said transverse pushing means are arranged on the outer side of the conveyors, and wherein said transverse pushing means taper to one another in the main conveyor direction.

2. A device according to claim 1, wherein the conveyors comprise conveyor surfaces that become narrower in the unification region.

3. A device according to claim 2, wherein the lifting means is arranged between the two conveyor surfaces and is a wedge-like belt element rising above the conveyor surfaces, or a revolving belt.

4. A device according to claim 2, wherein the conveyor surfaces in each case comprise a plurality of parallel running conveyor belts, wherein the end regions of the plurality of parallel running conveyor belts in the unification region in the main conveyor direction are staggered from the outside to the inside.

5. A device according to claim 4, wherein the innermost conveyor belts extend through the whole unification region and at its exit to form a conveyor surface for the unified printed product flow.

6. A device according to claim 1, wherein the two transverse pushing means grip the outer edge regions of the printed products.

7. A device according to claim 6 wherein the transverse pushing means are pairs of revolving pressing belts which may be pressed against one another, wherein a press gap is arranged between the pressing belts at the level of the conveyor surfaces.

8. A device according to claim 1, comprising an alignment means for aligning the printed products conveyed in the feed flows in the main conveyor direction and/or transversely thereto, wherein said alignment means is provided in front of the unification region in the main conveyor direction.

* * * * *